US006157286A

United States Patent [19]

Ranjan et al.

[11] Patent Number: 6,157,286

[45] Date of Patent: Dec. 5, 2000

[54] HIGH VOLTAGE CURRENT LIMITING DEVICE

[75] Inventors: Radhakrishnan Ranjan, Hickory, N.C.; Donald Kenneth Ferguson, Peterborough, Canada; Anil Raj Duggal; Minyoung Lee, both of Niskayuna, N.Y.

[73] Assignee: General Electric Company, Schenectady, N.Y.

[21] Appl. No.: 09/286,063

[22] Filed: Apr. 5, 1999

[51] Int. Cl.[7] ..... H01H 37/76; H01H 39/00; H01H 85/38; H01H 85/042; H01C 7/10

[52] U.S. Cl. ..... 337/35; 337/19; 337/20; 337/23; 337/30; 337/278; 337/273; 337/291; 337/12; 361/126; 361/106; 338/22 R; 338/23

[58] Field of Search ..... 337/158, 169, 337/171, 186, 203, 223, 225, 273, 276, 278, 291, 12, 14, 15, 298, 19, 20, 23, 24, 28, 30, 33, 35; 338/22 R, 22 SD, 20, 23, 211, 212, 52, 57, 333, 335; 219/328, 330, 331, 505, 553; 361/27, 58, 106, 126

[56] References Cited

U.S. PATENT DOCUMENTS

| | | | |
|---|---|---|---|
| 480,802 | 8/1892 | Blathy | 337/278 |
| 729,729 | 6/1903 | Burke | 337/278 |

(List continued on next page.)

FOREIGN PATENT DOCUMENTS

| | | |
|---|---|---|
| 0 026 456 | 4/1981 | European Pat. Off. . |
| 0 087 884 | 9/1983 | European Pat. Off. . |
| 0 240 447 | 10/1987 | European Pat. Off. . |
| 0 363 746 | 4/1990 | European Pat. Off. . |
| 0 487 920 | 6/1992 | European Pat. Off. . |

(List continued on next page.)

OTHER PUBLICATIONS

U.S. Ser. No. 610,947, Howell et al., filed May 16, 1984.

Glass Transition Temperature as a Guide to Selection of Polymers Suitable for PTC Materials, J. Meyer, Polymer Engineering And Science, Nov., 1973, vol. 13, No. 6, pp. 462–468.

Stability of Polymer Composites as Positive–Temperature–Coefficient Resistors, J. Meyer, Polymer Engineering And Science, Oct., 1974, vol. 14, No. 10, pp. 706–716.

*Primary Examiner*—Leo P. Picard
*Assistant Examiner*—Anatoly Vortman
*Attorney, Agent, or Firm*—Cantor Colburn LLP; Carl B. Horton

[57] ABSTRACT

A high voltage, current limiting device is connected in series with a high voltage power source and a protected load to interrupt current for an over-current condition [Typically 50 kA]. The current limiting device includes a current sensor/isolator and a switch connected in series. A current limiter, which may include a fuse or polymer current limiting material, is connected in parallel to the current sensor/isolator. The current sensor/isolator includes a pair of electrically insulated supports secured to a plurality of support rods to maintain the insulated supports at a predetermined fixed spacing to support an expulsion fuse. The expulsion fuse link includes a pair of copper conductors of adequate current carrying capability that are attached to ends of a main weak link fuse. A pair of coil springs hold the weak link fuse under tension to repel the conductors apart when the weak link fuse melts open during an over-current condition. An electrically insulating flapper pivotally connected at one end of a support rod provides a barrier between the source side and the load side of the current sensor/isolator when the main weak fuse melts open. One embodiment of the current limiter may include a high voltage polymer current limiting (PCL) device having a conductor-filled polymer composite material disposed between a pair of electrodes. The electrodes are forced inwardly by a pair of opposing springs to compress the composite material. The composite material, electrodes and springs are surrounded by pure silica, e.g., sand, within an enclosure.

39 Claims, 3 Drawing Sheets

U.S. PATENT DOCUMENTS

| | | | |
|---|---|---|---|
| 2,245,346 | 6/1941 | Klein | 337/278 |
| 2,933,574 | 4/1960 | Frink | 200/144 |
| 2,978,665 | 4/1961 | Vernet et al. | 338/223 |
| 3,046,371 | 7/1962 | Jencks | 200/88 |
| 3,226,600 | 12/1965 | Zielasek | 315/209 |
| 3,243,753 | 3/1966 | Kohler | 338/31 |
| 3,265,841 | 8/1966 | Greber | 337/219 |
| 3,488,761 | 1/1970 | Ito et al. | 337/221 |
| 3,548,358 | 12/1970 | Klein | 337/83 |
| 3,632,926 | 1/1972 | Heft | 200/144 C |
| 3,648,002 | 3/1972 | Rocher | 200/166 C |
| 3,673,121 | 6/1972 | Meyer | 252/511 |
| 3,914,727 | 10/1975 | Fabricius | 338/22 R |
| 3,978,300 | 8/1976 | Slade | 200/147 R |
| 4,001,742 | 1/1977 | Jencks et al. | 335/173 |
| 4,017,715 | 4/1977 | Whitney et al. | 219/553 |
| 4,019,097 | 4/1977 | Miller et al. | 361/93 |
| 4,077,025 | 2/1978 | Slade et al. | 335/16 |
| 4,101,862 | 7/1978 | Takagi et al. | 338/23 |
| 4,107,640 | 8/1978 | Asano et al. | 338/23 |
| 4,115,829 | 9/1978 | Howell | 361/42 |
| 4,132,968 | 1/1979 | Lang | 335/16 |
| 4,164,772 | 8/1979 | Hingorani | 361/58 |
| 4,165,502 | 8/1979 | Andersen | 335/39 |
| 4,178,618 | 12/1979 | Khalid | 361/58 |
| 4,237,441 | 12/1980 | Konynenburg et al. | 338/22 R |
| 4,292,261 | 9/1981 | Kotani et al. | 264/24 |
| 4,304,987 | 12/1981 | Konynenburg | 219/553 |
| 4,317,027 | 2/1982 | Middleman et al. | 219/553 |
| 4,329,669 | 5/1982 | Krasser et al. | 335/20 |
| 4,329,726 | 5/1982 | Middleman et al. | 361/58 |
| 4,333,861 | 6/1982 | Aoki et al. | 252/518 |
| 4,347,539 | 8/1982 | Peterson et al. | 361/16 |
| 4,374,049 | 2/1983 | Ellis et al. | 252/519 |
| 4,375,021 | 2/1983 | Pardini et al. | 200/147 B |
| 4,380,749 | 4/1983 | Eichelberger et al. | 338/215 |
| 4,404,237 | 9/1983 | Eichelberger et al. | 427/96 |
| 4,413,301 | 11/1983 | Middleman et al. | 361/106 |
| 4,458,283 | 7/1984 | Iida | 361/76 |
| 4,459,495 | 7/1984 | Gheewala | 307/306 |
| 4,485,283 | 11/1984 | Hurtle | 200/144 R |
| 4,487,811 | 12/1984 | Eichelberger et al. | 428/546 |
| 4,511,772 | 4/1985 | Link et al. | 200/144 R |
| 4,513,268 | 4/1985 | Seymour et al. | 335/35 |
| 4,573,259 | 3/1986 | Seymour et al. | 29/602 R |
| 4,583,146 | 4/1986 | Howell | 361/13 |
| 4,642,136 | 2/1987 | Fukushima et al. | 75/234 |
| 4,645,889 | 2/1987 | Howell | 200/144 AP |
| 4,646,053 | 2/1987 | Mosesian | 337/232 |
| 4,649,455 | 3/1987 | Scott | 361/93 |
| 4,652,975 | 3/1987 | Scott | 361/404 |
| 4,677,266 | 6/1987 | Belbel et al. | 200/151 |
| 4,685,025 | 8/1987 | Carlomagno | 361/106 |
| 4,746,896 | 5/1988 | Mcquaid et al. | 338/314 |
| 4,749,829 | 6/1988 | Ikeda et al. | 200/144 AP |
| 4,752,660 | 6/1988 | Yokoyama et al. | 200/151 |
| 4,754,247 | 6/1988 | Raymont et al. | 335/202 |
| 4,764,650 | 8/1988 | Bur et al. | 200/153 G |
| 4,780,598 | 10/1988 | Fahey et al. | 219/511 |
| 4,782,583 | 11/1988 | Castonguay et al. | 29/622 |
| 4,789,848 | 12/1988 | Castonguay et al. | 335/167 |
| 4,806,893 | 2/1989 | Castonguay et al. | 335/20 |
| 4,816,958 | 3/1989 | Belbel et al. | 361/93 |
| 4,884,164 | 11/1989 | Dziura et al. | 361/97 |
| 4,890,186 | 12/1989 | Matsubara et al. | 361/103 |
| 4,894,633 | 1/1990 | Holtfreter | 337/278 |
| 4,937,696 | 6/1990 | Yoshino et al. | 361/11 |
| 4,949,060 | 8/1990 | Mikulecky | 337/4 |
| 4,963,849 | 10/1990 | Kowalczyk et al. | 335/201 |
| 4,965,544 | 10/1990 | Kelaita, Jr. et al. | 335/202 |
| 4,967,304 | 10/1990 | Dougherty | 361/31 |
| 4,970,481 | 11/1990 | Arnold et al. | 335/6 |
| 5,057,674 | 10/1991 | Smith-Johannsen | 219/553 |
| 5,068,634 | 11/1991 | Shrier | 338/21 |
| 5,105,178 | 4/1992 | Krumme | 337/140 |
| 5,130,688 | 7/1992 | Van Rietschoten et al. | 337/231 |
| 5,142,265 | 8/1992 | Motoyoshi et al. | 338/22 R |
| 5,166,658 | 11/1992 | Fang et al. | 338/23 |
| 5,185,590 | 2/1993 | DiVincenzo | 335/201 |
| 5,210,517 | 5/1993 | Abe | 338/22 R |
| 5,227,946 | 7/1993 | Jacobs et al. | 361/106 |
| 5,247,276 | 9/1993 | Yamazaki | 338/22 R |
| 5,260,848 | 11/1993 | Childers | 361/127 |
| 5,268,661 | 12/1993 | Grunert et al. | 335/16 |
| 5,293,297 | 3/1994 | Desai | 361/106 |
| 5,296,996 | 3/1994 | Hansson et al. | 361/24 |
| 5,303,115 | 4/1994 | Nayar et al. | 361/106 |
| 5,313,180 | 5/1994 | Vial et al. | 335/16 |
| 5,313,184 | 5/1994 | Greuter et al. | 338/21 |
| 5,345,210 | 9/1994 | Swensen et al. | 337/163 |
| 5,373,273 | 12/1994 | Guery et al. | 335/201 |
| 5,382,938 | 1/1995 | Hansson et al. | 338/22 R |
| 5,414,403 | 5/1995 | Greuter et al. | 338/22 R |
| 5,416,462 | 5/1995 | Demarmels et al. | 338/22 R |
| 5,424,503 | 6/1995 | Neveu | 218/63 |
| 5,425,099 | 6/1995 | Takakura et al. | 379/413 |
| 5,426,406 | 6/1995 | Morris et al. | 335/202 |
| 5,428,195 | 6/1995 | Arnold | 218/1 |
| 5,432,140 | 7/1995 | Sumpter et al. | 502/167 |
| 5,436,274 | 7/1995 | Sumpter et al. | 521/88 |
| 5,436,609 | 7/1995 | Chan et al. | 338/22 R |
| 5,451,919 | 9/1995 | Chu et al. | 338/22 R |
| 5,471,035 | 11/1995 | Holmes | 219/505 |
| 5,471,185 | 11/1995 | Shea et al. | 335/51 |
| 5,473,495 | 12/1995 | Bauer | 361/11 |
| 5,495,083 | 2/1996 | Aymami-Pala et al. | 218/1 |
| 5,530,613 | 6/1996 | Bauer et al. | 361/58 |
| 5,539,370 | 7/1996 | Arnold | 337/8 |
| 5,545,679 | 8/1996 | Bollinger, Jr. et al. | 523/512 |
| 5,565,826 | 10/1996 | Karlstrom | 335/16 |
| 5,581,192 | 12/1996 | Shea et al. | 324/722 |
| 5,602,520 | 2/1997 | Baiatu et al. | 338/22 R |
| 5,614,881 | 3/1997 | Duggal et al. | 338/22 R |
| 5,644,283 | 7/1997 | Grosse-Wilde et al. | 338/20 |
| 5,663,861 | 9/1997 | Reddy et al. | 361/106 |
| 5,667,711 | 9/1997 | Mody et al. | 219/505 |
| 5,731,561 | 3/1998 | Manthe et al. | 218/35 |
| 5,796,568 | 8/1998 | Baiatu | 361/106 |
| 5,796,569 | 8/1998 | Gronowicz, Jr. | 361/106 |
| 5,896,264 | 4/1999 | Bijlenga et al. | 361/106 |
| 5,933,311 | 8/1999 | Chen et al. | 361/106 |

FOREIGN PATENT DOCUMENTS

| | | | |
|---|---|---|---|
| 0 576 836 | 1/1994 | European Pat. Off. . | |
| 0 640 995 | 3/1995 | European Pat. Off. . | |
| 0 713 227 | 5/1996 | European Pat. Off. . | |
| 0 747 910 | 12/1996 | European Pat. Off. . | |
| 0 773 562 | 5/1997 | European Pat. Off. . | |
| 0 809 267 | 11/1997 | European Pat. Off. . | |
| 0 762 439 | 12/1997 | European Pat. Off. . | |
| 42 28 297 | 3/1994 | Germany . | |
| 43 30 607 | 3/1995 | Germany . | |
| 410134699A | 5/1998 | Japan | H01H 85/36 |
| 410145964A | 5/1998 | Japan | H02H 9/02 |
| 15 70 138 | 6/1980 | United Kingdom . | |
| WO 91/12643 | 8/1991 | WIPO . | |
| WO 91/19297 | 12/1991 | WIPO . | |
| WO 93/07667 | 4/1993 | WIPO . | |
| WO 93/21677 | 10/1993 | WIPO . | |
| WO 94/10734 | 5/1994 | WIPO . | |
| WO 95/03619 | 2/1995 | WIPO . | |
| WO 95/19297 | 7/1995 | WIPO . | |
| WO 95/34931 | 12/1995 | WIPO . | |
| WO 97/49102 | 12/1997 | WIPO . | |

HIGH VOLTAGE CURRENT LIMITING DEVICE

BACKGROUND OF THE INVENTION

The present invention relates generally to high voltage current limiting devices and in particular, to high voltage, high current sensor/isolator connected in parallel with a current limiter, electrically isolated by a switching device (a spark gap).

High voltage current limiting fuses have been in service for over half a century. They limit peak value of the fault current when operating in their current limiting mode. It is desirable to keep this peak value of the let-through current as low as possible for any available current. The peak let-through current by a fuse increases with its rated continuous current. Thus, for a fixed maximum available fault current, typically 50 kA, a current limiting fuse with a high rated continuous current (1000 A or greater) may not limit the peak value of the fault current and may not provide the necessary protection. The market demands high current rated fuses with low let-through peak current and energy.

Polymer current limiting devices have been applied to limit current at low voltages, i.e., <660 V, in restricted applications. However, there appears to be no application of these devices at high voltages [1000 V and higher] for over-current protection.

The need for high voltage, high continuous rated current fuses with low peak let-through current capability is on the rise. The art of paralleling existing silver sand technology fuses become saturated at this level since the current limiting range is outside the maximum interrupting current, typically 50 kA. High continuous current rated devices currently available in the Market [U.S. Pat. No. 4,692,577 & U.S. Pat. No. 4,479,105], carry the load current on copper conductors, in parallel with current limiting devices isolated from them. When a system fault occurs, the high fault current is shunted to the current limiting device to work in the current limiting range. These devices need a special circuit to measure the current at all times. Tiny failure in the measuring system, these devices will not interrupt and isolate the faulty circuit.

BRIEF SUMMARY OF THE INVENTION

In an exemplary embodiment, a current limiting device for suppressing peak value of the fault current to a protected unit includes a pair of first and second electrically conductive electrodes disposed within an enclosure. At least one current limiting element in series with a current sensor is electrically connected between the electrodes, whereby load current passes through the current limiting element and the sensor. The current limiting element limits the fault current to a predetermined value upon occurrence of an over-current condition. The current limiting element includes a polymeric conductor and a resistive layer. The resistive layer is in close proximate to and in series with the polymeric conductor and the protected circuit. The resistive layer has a higher resistivity than the polymeric conductor. When an over-current condition occurs, it causes resistive heating at the resistive layer resulting in rapid thermal expansion and vaporization of the polymeric conductor at the resistive layer. This causes at least partial separation at the resistive layer, resulting in rapid suppression of the fault current. A silica material is also disposed within the enclosure around the current limiting element to absorb the energy released from its operation.

In another exemplary embodiment of the present invention, a current limiting device for limiting current to a load includes a current isolator electrically connected in series with the load. The current isolator has a pair of electrically insulated supports disposed laterally-spaced at a predetermined distance. A fuse element [current sensor] electrically connected between a pair of conductors, wherein each of the conductors extends through the insulated supports. A flapper is disposed intermediate to the conductors to provide a barrier between the conductors. When the fuse element melts open in response to a fault current, the flapper operates and provides a barrier between the conductors. This shunts the current to the current limiter electrically connected in parallel with the current isolator. The current limiter limits the fault current to a low value. A series switch isolates the protected system from the source.

BRIEF DESCRIPTION OF THE DRAWINGS

Referring now to the drawings wherein like elements are numbered alike in the several FIGURES.

DETAILED DESCRIPTION OF THE INVENTION

Figure 1:
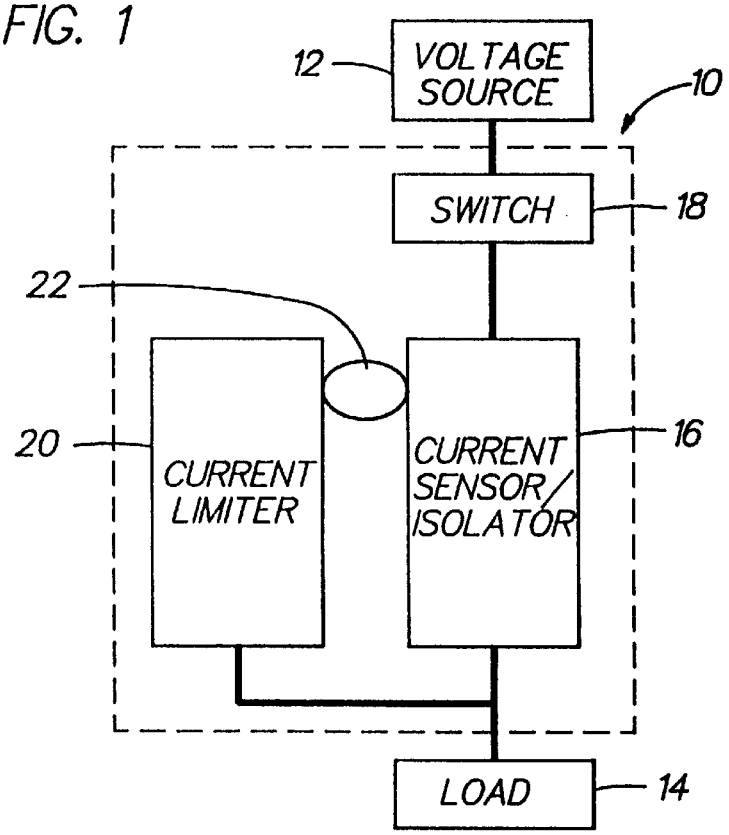
FIG. 1 is a diagrammatic block diagram of a current limiting device embodying the present invention.

Referring now to FIG. 1, a current limiting device with high rated continuous current [high current limiting device], generally designated as 10, is shown. The current limiting device 10 is connected in series with a power source 12 and a load 14 (i.e., protected circuit) to interrupt current to the load when the current exceeds a predetermined maximum current, which may be as high as 50 kilo-amperes (kA). The high current limiting device 10 includes a current sensor/isolator 16 and a switch 18 connected in series with the power source 12 and load 14. A current limiter 20 comprising a fuse and/or polymer current limiting material is connected in parallel to the current sensor/isolator 16. The current limiter 20 is isolated from the current sensor/isolator 16 by a controlled spark gap 22 [or other suitable switching devices]. The switch 18 is only necessary for use with the current limiter 20 having the polymeric current limiting material, as will be described in greater detail hereinafter.

Generally under normal operation [carrying rated load current] of the current limiting device 10, the current limiter 20 does not carry any current. The load currents are carried only by the current sensor/isolator 16 and switch 18. When this current flowing through the current sensor/isolator exceeds a pre-determined value, the current sensor/isolator melts open and the copper conductors 30 separates by the action of the springs 36. The flapper 44 [described below] made of the current limiter material, is interposed to develop a high dielectric strength to withstand the voltages across the copper conductors 30. At this time, the switching device 22 shunts the fault current to the current limiter 20. The current limiter 20 limits the peak magnitude of this current and helps the switch 18 to open and isolate the protected circuit 14.

The series switch 18 is capable of interrupting all currents below a maximum current limited by the current limiter 20.

Figure 2:
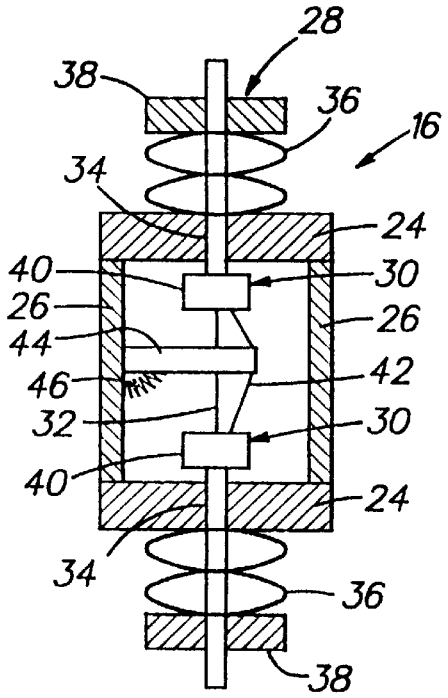
FIG. 2 is a sectional view of a current sensor/isolator of the current limiting device of FIG. 1.

Referring to FIG. 2, the current sensor/isolator 16 includes a pair of electrically insulated supports 24 secured to a plurality of support rods 26 to maintain the insulated supports at a predetermined fixed spacing there between. The current sensor/isolator 16 may include an expulsion fuse link assembly 28 generally known in the art.

This assembly 28 includes a pair of copper conductors 30 of adequate current carrying capability that are attached to ends of a main weak link fuse 32. Each of the copper conductors 30 extend through a central hole 34 disposed in each respective insulated support 24. A coil spring 36 is retained under a predetermined force between an outer surface of the insulated support 24 and a retention plate 38 secured to the copper conductor 30. The springs 36 hold the weak link fuse 32 under tension such that the springs function to repel the internal ends 40 of the conductors 30 outward when the weak link fuse 32 melts open during an over current condition. A strain wire 42, similar to the one used in existing expulsion fuse links has its ends secured to the internal ends 40 of the conductors 30, which is used to minimize the strain on the main weak link fuse 32.

The current sensor/isolator 16 further includes an electrically insulating flapper 44 having a generally triangular shape, pivotally connected at one end of a support rod 26. A spring 46 engaging the flapper 44 urges the flapper against the weak link fuse 32. The flapper 44 is formed of electrically insulative material such as PTFE [poly-tetra-fluoro-ethylene, also known as TEFLON® in Industry], and/or a polymer current limiting material such as that described in U.S. Pat. No. 5,614,881 assigned to General Electric Company and U.S. patent application Ser. No. 5,614,881 filed on Jan. 2, 1997, each of which are incorporated herein by reference.

Figure 3:
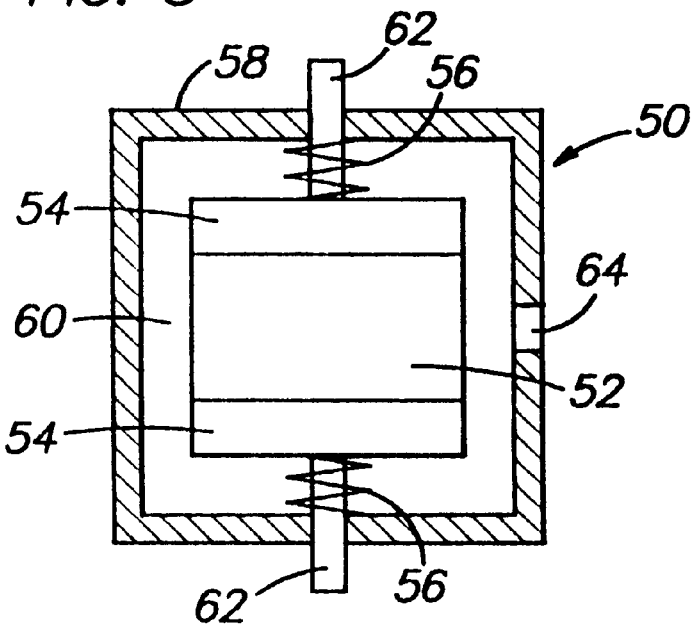
FIG. 3 is a sectional view of a current limiter of the current limiting device of FIG. 1.

The current limiter 20 may include a current limiting fuse as is known in the art, or a high voltage polymer current limiting (PCL) device 50 as shown in FIG. 3. The PCL device 50 comprises a conductor-filled polymer composite material 52 disposed between a pair of electrodes 54. The polymer composite 52 comprises a highly conducting composite material with low pyrolysis temperature binder and conducting filler, which is similar to that disclosed in U.S. Pat. No. 5,614,881 to Duggal et al., and U.S. patent application Ser. No. 08/778,434. The operation of the PCL device does not require that the composite material 52 exhibit a PTCR (positive-temperature coefficient of resistance) or PTC effect.

The polymer composite material 52 is an electrically conductive composite material providing an inhomogeneous distribution of resistance throughout the PCL device 50. The inhomogeneous resistance distribution of the composite material 52 should be arranged so that at least one thin layer of the PCL device 50 is positioned perpendicular to the direction of the current flow and has a much higher resistance than the average resistance for an average layer of the same size and orientation in the PCL device. In one embodiment, the higher resistance layer is formed in the material 52 at one or both interface(s) with the electrode 54 by reducing the true contact area between the electrode and material. This can be accomplished, for example, by roughening the surface of the composite material and pressure contacting a metal electrode to the surface. Alternatively, it can be accomplished without the application of pressure by vapor depositing a metal electrode onto the material. In an another embodiment, one or more high resistance layers can be created away from the electrode interface(s) and within the bulk of the material. This can be achieved using pressure contacting rough surfaces of two pieces of the material together or by modifying the composition of a thin layer (e.g. using less conductive filler in the thin layer) of the material away from the electrodes.

FIG. 3 depicts the embodiment where the high resistance layer is created by pressure-contacting the electrodes to the material. Here, the electrodes 54 are forced inwardly by a pair of opposing springs 56 to compress the composite material 52 between the electrodes 54. The composite material, electrodes and springs are surrounded by pure silica 60, e.g., sand, quartz, etc., within an enclosure 58. A pair of conductors 62 pass through the enclosure 58 to electrically connect to the electrodes 54. This provides an electrical connection for the PCL device 50 wherein one conductor is connected to the controlled spark gap 22 and the second conductor is electrically connected to the load side of the current sensor/isolator 16.

In the operation of the current limiting device 10, the weak link fuse 32 melts open at a predetermined over-current. The coil springs 36 repel the copper conductors 30 outward, away from each other to thereby increase the electrical gap there between. The now unsupported flapper 44 rotates to the center of the current sensor/isolator 16 between the conductors 30 to provide a barrier between the source side and the load side of the current sensor/isolator. Consequently, when the current sensor/isolator opens, an arc is formed. The spark gap 22, flashes over due to the arc voltage, transferring the current to the current limiter 20 as best shown in FIG. 1. The current limiter 20 suppresses the current to a very low magnitude. The current sensor/isolator 16 builds up sufficient dielectric recovery strength to withstand the transient system recovery voltage.

The PCL material of the current limiter 20 switches to limit the over-current and after a short time the switch 18 opens the circuit. The spark gap 22 and the switching time of the PCL material are coordinated with the rate of recovery of the dielectric strength of the current sensor/isolator 16.

In the operation of the PCL device 50, the resistance of the PCL device 50, which includes the resistance of the highly conducting composite material 52, the electrodes 54, and the contacts, is low. When the fuse link 28 of the current sensor/isolator 16 opens and fault current flows through the PCL device 50, a high current density path is established through the PCL device. In the initial stages of short-circuit condition, the resistive heating of the PCL device 50 is believed to be approximately adiabatic. Thus, it is believed that the selected thin, more resistive layer of the PCL device heats up much faster than the rest of the PCL device. With a properly designed thin layer, it is believed that the thin layer heats up so quickly that thermal expansion of and/or gas evolution from the thin layer cause a separation within the PCL device 50 at the thin layer.

In the PCL device 50, it is believed that the vaporization and/or ablation of the composite material 52 cause the electrode 54 to separate from the composite material. In this separated state, it is believed that ablation of the compos ite material occurs and arcing between the separated layers of the PCL device 50 can occur. However, the overall resistance in the separated state is much higher than in the non-separated state. This high arc resistance is believed due to the high pressure generated at the interface by the gas evolution from the composite binder combined with the de-ionizing properties of the gas. In any event, the current limiting device of the present invention is effective in limiting the fault current magnitude so that the other components of the load 14 are not harmed.

During the operation under fault current condition, the composite material 52 emit gases, namely carbon based gases such as $CO_2$, during the current limiting operation. The volume of hot gases generated is proportional to the mass of the material depleted, which is related to the energy absorbed during current limiting operation. At high voltages, increased hot gas release is expected due to the higher energy involved, which can make prior-art packaging schemes impractical. To absorb this higher energy, the pure silica 60 surrounds the pressure-contacted composite material 52 inside the enclosure 58. The silica absorbs energy from the hot gases forming fulgurites. The warm gases are then cooled and bled through a vent hole 64 to the atmosphere. Venting of the gases limits the destructive potential of the released gas.

Figure 4:
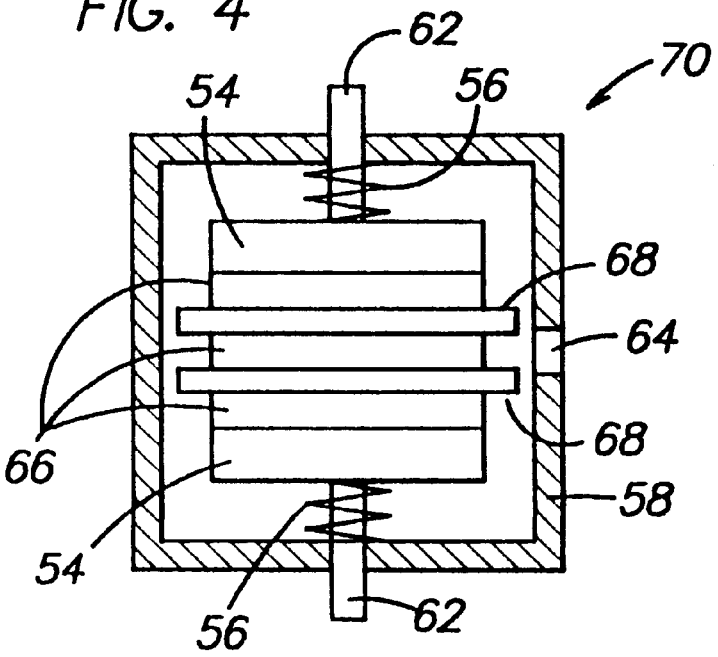
FIG. 4 is a sectional view of an alternative embodiment of the current limiter of FIG. 3.

Referring to FIG. 4, an alternative embodiment 70 of the PCL device 50 is illustrated that allows high voltage operation using polymer composite material 52, the same as described hereinbefore, with a thick plate geometry. Specifically, a plurality of sections 66 of composite material is stacked for withstanding a high voltage. The contact between the sections 66 of composite material can be thin wafers 68 of conductive material, such as copper, aluminum or silver material. Alternatively, these conductive materials can be vapor deposited on the upper and lower surfaces of the sections 66 of composite material. The thickness of the stacked composite material should be such that the voltage drop across it during current limiting operation should not cause arc over between the two thin conducting materials 68. An optimum pressure can be applied mechanically by springs 56 or an insulated bolt.

While the current limiter 20 of the current limiting device 10 not dependent upon PTC effect, one will appreciate that the composite material may comprise of a polymeric material that exhibits PTC effect.

Figure 5:
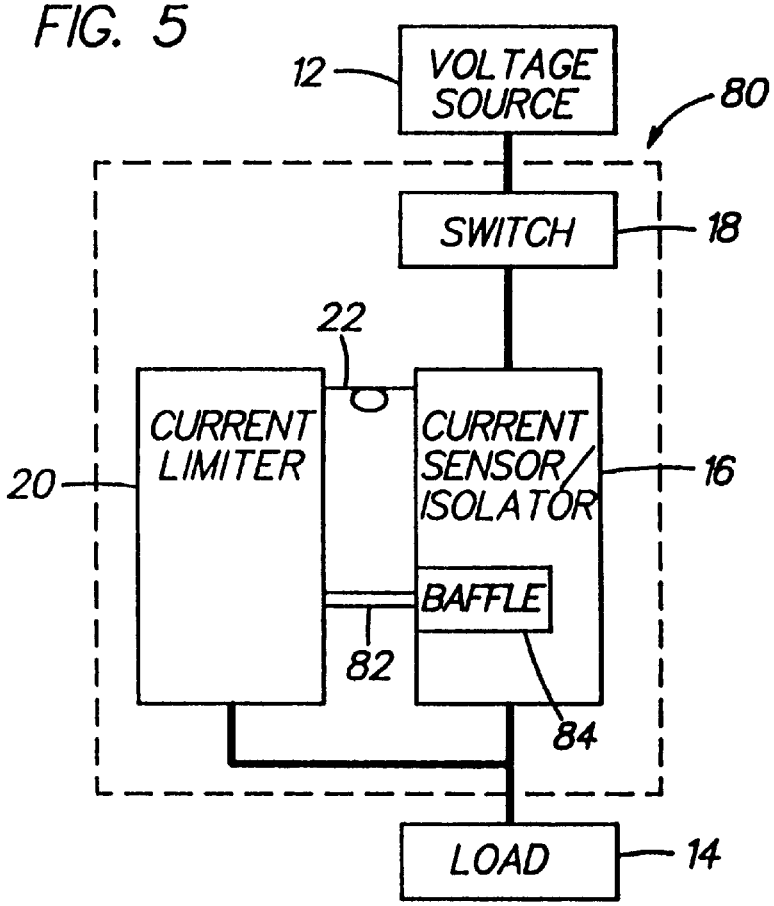
FIG. 5 is a diagrammatic block diagram of an alternative embodiment of the current limiting device of FIG. 1.

Referring to FIG. 5, another embodiment of high current limiting device 80 of the present invention is illustrated, which utilizes the gases evolved during the current limiting operation. The high current limiting device 80 is substantially similar to the current limiting device 10 illustrated in FIG. 1, wherein same components are numbered alike.

The current limiter 20 further includes a non-conducting device 82, such as a pipe or tube that directs the gases exiting to a vent hole 64 to the current sensor/isolator 16 during its operation in the current limiting mode. The hot gases are used for positive isolation of the current sensor/isolator 16 and to quench any arcing.

In the embodiment shown in FIG. 5, the current sensor/isolator assumes to solely develop the full dielectric strength before the series switch 18 opens. The hot, ionized gases are directed under pressure to the current sensor/isolator 16 in this region to build faster voltage withstand strength. In addition, the hot gases can also introduce a dielectric medium, such as a baffle 84 between the terminals of the current sensor/isolator 16 after the weak link fuse 32 has opened.

Figure 6:
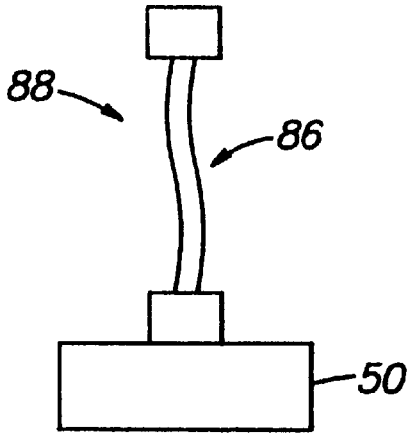
FIG. 6 is a diagrammatic block diagram of an alternative embodiment of a current limiting device embodying the present invention.

While the PCL device 50 may be combined in parallel to a current sensor/isolator 16, one will recognize that the PCL device 50 may also be connected in series with a standard (non-current-limiting) expulsion fuse 86 or other Industrial Standard cutouts fuse links, as illustrated in FIG. 6. The resultant current limiting device 88 is a current limiting expulsion fuse. We note that various design options are available to make a single integral device with both a PCL component as outlined above and an expulsion fuse component. One will also appreciate that this current limiting device 88 may also be used for low current protection, which does not require the composite material to be surrounded by silica.

In addition, while the current limiters 50, 70 of FIGS. 3 and 4, respectively, are shown connected in shunt relations to the current sensor/isolator 16 of FIG. 1, one skilled in the art will appreciate that current limiters may be used in series with the load 14 to suppress the high fault current at high voltages.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A current limiting device for limiting the fault current and electrically isolating a load, the current limiting device comprising:

an enclosure;

a pair of first and second electrically conductive electrodes disposed within the enclosure;

at least one current limiting element electrically connected between the electrodes whereby load current passes through said current limiting element and is limited to a predetermined value upon occurrence of an over-current condition, the current limiting element comprising:

a polymeric conductor; and a resistive layer, proximate to and in series with the polymeric conductor and the load, having a higher resistivity than the polymeric conductor, whereby the over-current condition causes resistive heating at the resistive layer resulting in rapid thermal expansion and vaporization of the polymeric conductor at said resistive layer causing at least partial separation at said resistive layer thereby causing rapid suppression of the fault current; and at least one spring for providing compression force to the current limiting element, one of said at least one spring being arranged intermediate the enclosure and one of said first and second electrically conductive electrodes.

2. The current limiting device of claim 1 wherein the enclosure includes a vent opening disposed therein.

3. The current limiting device of claim 1 the polymeric conductor is not dependent on a positive temperature coefficient of electrical resistance.

4. The current limiting device of claim 1 wherein the polymeric conductor includes an electrically conductive filler.

5. The current limiting device of claim 1 further includes a fuse electrically connected in series with one of the first and second conductive electrodes.

6. The current limiting device of claim 5 wherein the fuse is an expulsion fuse.

7. The current limiting device of claim 1 wherein at least one current limiting element comprises a plurality of stacked current limiting elements and a layer of conductive material disposed intermediate a pair of stacked current limiting elements.

8. The current limiting device of claim 7 wherein the conductive layer is formed of conductive metallic material.

9. The current limiting device of claim 7 wherein the conductive material is deposited on a surface of a current limiting element intermediate abutting stacked current limiting elements by vapor deposit.

10. The current limiting device of claim 1 further comprisiing a silica material disposed within the enclosure about the current limiting element.

11. A current limiting device for suppressing current to a load, the current limiting device comprising:

a current isolator electrically connected in series with the load, the current isolator comprising:

a pair of electrically-insulated supports disposed laterally spaced a predetermined distance;

a pair of conductors, each of the conductors extending through the insulated supports;

a fuse element electrically connected between the pair of conductors; and a flapper disposed intermediate the conductors to provide a barrier between the conductors when the fuse element opens in response to an over-current condition; and a current limiter electrically connected in parallel with the current isolator.

12. The current limiting device of claim 11 further includes a pair of springs wherein each spring engages a conductor for urging the conductors away from the fuse element.

13. The current limiting device of claim 12 wherein each conductor includes a retention plate for engaging an end of each of the pair of springs.

14. The current limiting device of claim 11 further comprising a strain wire secured between the pair of conductors.

15. The current limiting device of claim 11 further comprising bias spring connected to the flapper for urging the flapper to a position intermediate the pair of conductors.

16. The current limiting device of claim 11 wherein one end of the current limiter is electrically connected to the current isolator by a spark gap.

17. The current limiting device of claim 11 wherein current limiter comp ris es polymer current limiting material.

18. The current limiting device of claim 11 wherein current limiter comprises a current limiting fuse.

19. The current limiting device of claim 18 wherein the current limiting fuse includes an expulsion fuse.

20. The current limiting device of claim 11 wherein current limiter comprises a current limiting fuse electrically connected in series with a polymer current limiting element.

21. The current limiting device of claim 20 wherein current limiter comprises:

an enclosure;

a pair of first and second electrically conductive electrodes disposed within the enclosure;

at least one current limiting element electrically connected between the electrodes whereby load current passes through said current limiting element and becomes limited to a predetermined value upon occurrence of an over-current condition, the current limiting element comprising:

a polymeric conductor; and a resistive layer, proximate to and in series with the polymeric conductor in the load, having a higher resistivity than the polymeric (conductor, whereby the over-current condition causes resistive heating at the resistive layer resulting in rapid thermal expansion and vaporization of the polymeric conductor at said resistive layer causing at least partial separation at said resistive layer thereby causing rapid suppression of the fault current; and a silica material disposed within the enclosure about the current limiting element.

22. The current limiting device of claim 11 wherein the flapper comprises electrically insulating material.

23. The current limiting device of claim 22 wherein current flapper comprises poly-tetra-flouro-ethylene.

24. The current limiting device of claim 21 wherein the enclosure includes a vent opening disposed therein.

25. The current limiting device of claim 17 the polymeric conductor is not dependent on a positive temperature coefficient of electrical resistance.

26. The current limiting device of claim 21 wherein the polymeric conductor includes an electrically conductive filler.

27. The current limiting device of claim 22 further includes at least one spring for providing compressing force to the current limiting element.

28. The current limiting device of claim 12 wherein said at least one spring includes a pair of first and second springs for providing compressive force to the current limiting element, the first spring being arranged intermediate the enclosure and the first electrode, and the second spring being arranged intermediate the enclosure and the second electrode.

29. The current limiting device of claim 22 wherein the at least one current limiting element comprises a plurality of stacked current limiting elements and a layer of conductive material disposed intermediate a pair of stacked current limiting elements.

30. The current limiting device of claim 29 wherein the conductive layer is formed of conductive metallic material.

31. The current limiting device of claim 29 wherein the conductive material is deposited on a surface of a current limiting element intermediate abutting stacked current limiting elements by vapor deposit.

32. The current limiting device of claim 11 further including a conduit for conducting vented gases to the current isolator.

33. The current limiting device of claim 32 wherein the current isolator includes a baffle, the baffle in fluid communication with the exit gases to actuate the baffle to provide a barrier between the conductors of the current isolator upon opening of the fuse element.

34. The current limiting device of claim 11 further comprises a switch electrically connected in series with the current isolator.

35. A current isolator electrically connected in series with the load, the current isolator comprising:

a pair of electrically-insulated supports disposed laterally spaced a predetermined distance;

a pair of conductors, each of the conductors extending through the insulated supports;

a fuse element electrically connected between the pair of conductors;

a flapper disposed intermediate the conductors to provide a barrier between the conductors when the fuse element opens in response to an over-current condition; and a current limiter electrically connected in parallel with the current isolator.

36. The current isolator of claim 35 further includes a pair of springs wherein each spring engages a conductor for urging the conductors away from the fuse element.

37. The current isolator of claim 36 wherein each conductor includes a retention plate for engaging an end of each of the pair of springs.

38. The current isolator of claim 35 further comprising a strain gage secured between the pair of conductors.

39. The current isolator of claim 35 further comprising bias spring connected to the flapper for urging the flapper to a position intermediate the pair of conductors.

* * * * *

UNITED STATES PATENT AND TRADEMARK OFFICE

CERTIFICATE OF CORRECTION

PATENT NO. : 6,157,286
DATED : December 5, 2000
INVENTOR(S) : Ranjan et al.

It is certified that error appears in the above-identified patent and that said Letters Patent is hereby corrected as shown below:

Column 1,
Line 40, after "times." delete "Tiny" and insert therefor -- Any --.

Column 4,
Line 58, delete "compos ite" and insert therefor -- composite --.

Column 6,
Line 36, after "providing" delete "compression" and insert therefor -- compressive --.

Column 7,
Line 31, after "limiter" delete "comp ris es" and insert therefor -- comprises --.
Line 54, after "polymeric" delete "(".

Signed and Sealed this

Twenty-eighth Day of January, 2003

JAMES E. ROGAN
*Director of the United States Patent and Trademark Office*